US008458978B2

(12) United States Patent
Mahaffey

(10) Patent No.: US 8,458,978 B2
(45) **Date of Patent: *Jun. 11, 2013**

(54) REINFORCED SIDINGS

(75) Inventor: Kenneth Lee Mahaffey, Lawrenceville, GA (US)

(73) Assignee: Georgia Foam, Inc., Gainsville, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/625,651

(22) Filed: Nov. 25, 2009

(65) Prior Publication Data

US 2010/0132289 A1 Jun. 3, 2010

Related U.S. Application Data

(63) Continuation-in-part of application No. 11/142,840, filed on Jun. 1, 2005, now Pat. No. 7,698,866.

(60) Provisional application No. 60/598,776, filed on Aug. 4, 2004.

(51) Int. Cl.
*E04B 2/08* (2006.01)
*E04C 1/00* (2006.01)

(52) U.S. Cl.
USPC ..... 52/543; 52/309.4; 52/309.9; 52/506.05; 52/519

(58) Field of Classification Search
USPC ..... 52/309.4, 309.9, 530, 535, 519, 522, 52/543, 551, 718.04, 718.01, 718.02
See application file for complete search history.

(56) References Cited

U.S. PATENT DOCUMENTS

| | | | | |
|---|---|---|---|---|
| 2,232,786 | A * | 2/1941 | Kendall | 52/543 |
| 6,029,415 | A * | 2/2000 | Culpepper et al. | 52/522 |
| 6,195,952 | B1 * | 3/2001 | Culpepper et al. | 52/522 |
| 6,321,500 | B1 * | 11/2001 | Manning et al. | 52/555 |
| 6,526,718 | B2 * | 3/2003 | Manning et al. | 52/555 |
| 2008/0060307 | A1 * | 3/2008 | McIntyre | 52/543 |

OTHER PUBLICATIONS http://www.curbellplastics.com/technical-resources/pdf/thermal-expansion-plastics.pdf.*

* cited by examiner

*Primary Examiner* — Brian Glessner
*Assistant Examiner* — Adriana Figueroa
(74) *Attorney, Agent, or Firm* — Atlanta Technology Law

(57) ABSTRACT

Methods for fabricating sidings and methods for securing those sidings to structures are disclosed. Additionally, this disclosure teaches embodiments of sidings that can be secured to structures. For some embodiments, the siding comprises an insulation and a panel. The insulation and the panel are coupled to each other prior to installation of the siding. This coupling is achieved by non-adhesive coupling mechanisms.

16 Claims, 5 Drawing Sheets

REINFORCED SIDINGS

CROSS REFERENCE TO RELATED APPLICATIONS

This application claims the benefit of U.S. provisional patent application Ser. No. 60/598,776, filed on Aug. 4, 2004, and, is a continuation of co-pending U.S. patent application Ser. No. 11/142,840 filed on Jun. 1, 2005, both of which are incorporated herein by reference in their entirety.

FIELD OF THE DISCLOSURE

The present disclosure relates generally to sidings and, more particularly to reinforced sidings.

BACKGROUND

Insulated vinyl siding is known in the art. Some insulated vinyl sidings comprise contoured vinyl panels that are secured to contoured foam insulations by flexible adhesive. These vinyl sidings are typically installed onto structures, such as houses, by positioning the foam-side of the siding onto an exterior wall of the house, and driving a nail through a nailing hem of the vinyl panel. The nail is sequentially driven through the hem of the vinyl panel, the insulation, and the wall, thereby securing the siding to the house.

These types of insulated vinyl sidings, in which the vinyl panel is secured to the foam insulation by flexible adhesive, permits the foam insulation and the vinyl panel to independently expand and contract with changes in temperature. Unfortunately, the disadvantage of using such flexible adhesive is that the adhesive can telegraph through the vinyl siding, thereby causing visible patterns on the vinyl siding when installed onto the wall. Additionally, the independent expansion and contraction of the vinyl panel and the foam insulation sometimes causes a separation of the vinyl panel from the foam insulation. This phenomenon is also known as oil canning.

Rather than using flexible adhesive, others have proposed using a friction fit to secure the vinyl panel to the foam insulation. For that approach, the vinyl panel is fabricated with various lips or overhangs, such that the foam insulation can be inserted into the lip or overhang. Unfortunately, the fabrication of such lips and overhangs adds to the total cost of production for the vinyl panels. Also, the insertion of the foam insulation into the lip or overhang results in added complexity in assembling the contoured vinyl siding.

In view of these and other problems, a need exists in the art.

SUMMARY

Sidings and various methods associated with sidings are disclosed. Some embodiments, among others, of the siding comprise an insulation and a panel having coefficients of thermal expansion that are not equal. The insulation and the panel are coupled to each other prior to installation of the siding. This coupling is achieved by non-adhesive coupling mechanisms. This non-adhesive coupling mechanism allows the insulation and panel to move independently of one another to account for differences in thermal expansion.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
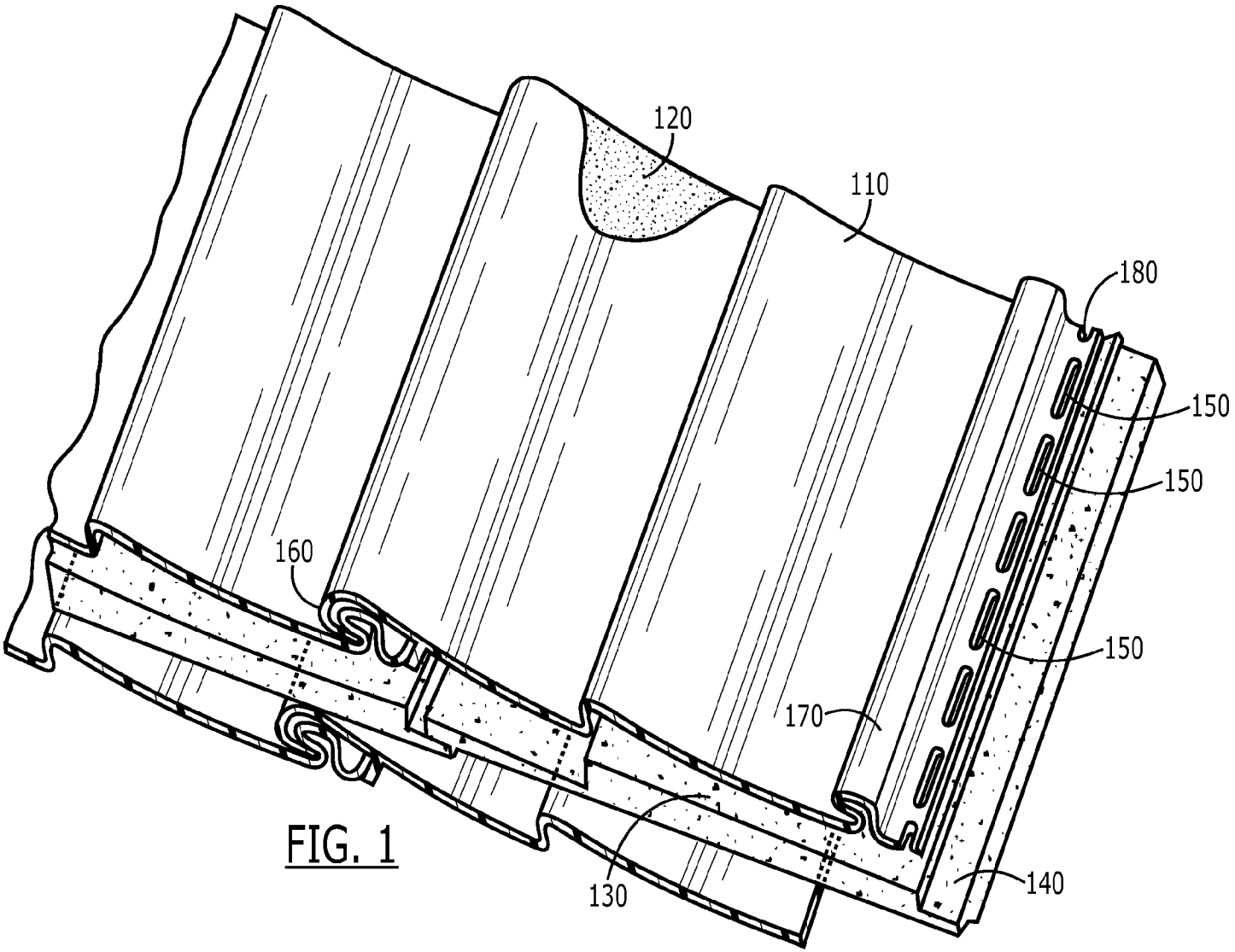
FIG. 1 shows a perspective view of an insulated siding.

Reference is now made in detail to the description of the embodiments as illustrated in the drawings. While several embodiments are described in connection with these drawings, there is no intent to limit the disclosure to the embodiment or embodiments disclosed herein. On the contrary, the intent is to cover all alternatives, modifications, and equivalents.

As noted above, insulated vinyl sidings, in which the vinyl panel is secured to the foam insulation by flexible adhesive, is problematic for various reasons. Various embodiments, disclosed herein, seek to remedy the problems associated with using flexible adhesive.

The vinyl panel and the insulation are solids composed of different materials. Solids typically expand in response to heat and contract on cooling. This dimensional response to temperature change is expressed by a material's coefficient of thermal expansion. The panel and insulation have unequal coefficients of thermal expansion. Since the panel and the insulation have unequal coefficients of thermal expansion, they expand and contract independently of one another when the temperature changes.

For some embodiments, rather than simply using flexible adhesive to secure a vinyl panel to a foam insulation, a non-adhesive coupling mechanism is used to couple the vinyl panel to the foam insulation. Unlike the flexible adhesive, the non-adhesive coupling mechanism does not suffer from oil canning or other separation caused by temperature fluctuations. As such, the non-adhesive coupling provides a robust way of securing the panel to the insulation, such that the structural integrity of the siding is relatively immune from temperature fluctuations.

FIG. 1 shows a perspective view of an insulated siding. As shown in FIG. 1, the insulated siding includes a panel 110, which, in this embodiment, is a contoured vinyl panel. The siding further includes an insulation 130, which has a contour that substantially corresponds to the contour of the panel 110. The panel 110 includes a nailing hem 180 that has multiple orifices 150. Typically, when installing sidings, nails are drive through these orifices 150 to secure the siding to outer walls of structures. However, for some embodiments of the invention, the orifices 150 also facilitate the mechanical coupling of the panel 110 to the insulation 130.

Additionally, the siding of FIG. 1 includes locking contours 160, 170, which are used to mate contiguous sidings. For some embodiments, the insulation 130 is contoured so that a ledge 140 is formed at one end of the insulation 130.

This ledge 140 permits contiguous pieces of insulation to overlap with each other, thereby reducing the potential for gaps between adjacent pieces of insulation 130. It should be noted that, while FIG. 1 shows a recessed ledge 140, for other embodiments, the ledge 140 may be raised above the level of the panel 110 or, alternatively, may be configured to be flush with the level of the panel 110. Since the mating of contiguous sidings is known in the art, no further discussion of such mating is provided here. The insulated siding of FIG. 1 also includes a flexible adhesive 120, which is known in the art. The flexible adhesive 120 provides additional security in coupling the panel 110 with the insulation 130. However, it should be appreciated that the flexible adhesive 120 in FIG. 1 is optional, insofar as the non-adhesive coupling mechanism 200, shown in FIG. 2, sufficiently secures the panel 110 with the insulation 130.

While a vinyl panel is shown in FIG. 1, it should be appreciated that, for other embodiments, the panel 110 can be metal (e.g., steel, aluminum, or other known metallic substance), composite, wood, or other known substances that are typically used, or can be used, for siding materials. Additionally, while the panel 110 of FIG. 1 is shown to be a contoured panel, for other embodiments, the panel 110 need not be contoured but can be a flat panel.

Also, while the insulation 130, in some embodiments, is foam insulation, it should be appreciated that other types of insulation can be used without detracting from the scope of the disclosure. For example, the insulation can be cardboard or other known materials that are used, and can be used, for insulation. In addition, the insulation 130 can incorporate flame-retardant materials to improve fire safety related to the siding. Furthermore, the insulation 130 can optionally include termite treatment to deter infection of the siding by termites.

For yet other embodiments, the insulation can be substituted with a non-insulating material that is simply provided to increase the structural rigidity of the panel 110. In that regard, the panel 110 can be mechanically fastened to a structural reinforcement material. For yet other embodiments, the insulation 130 can also function as the structural reinforcement material. Such structural enforcement material provides impact resistance to the panel 110, thereby providing a stronger product.

Figure 2:
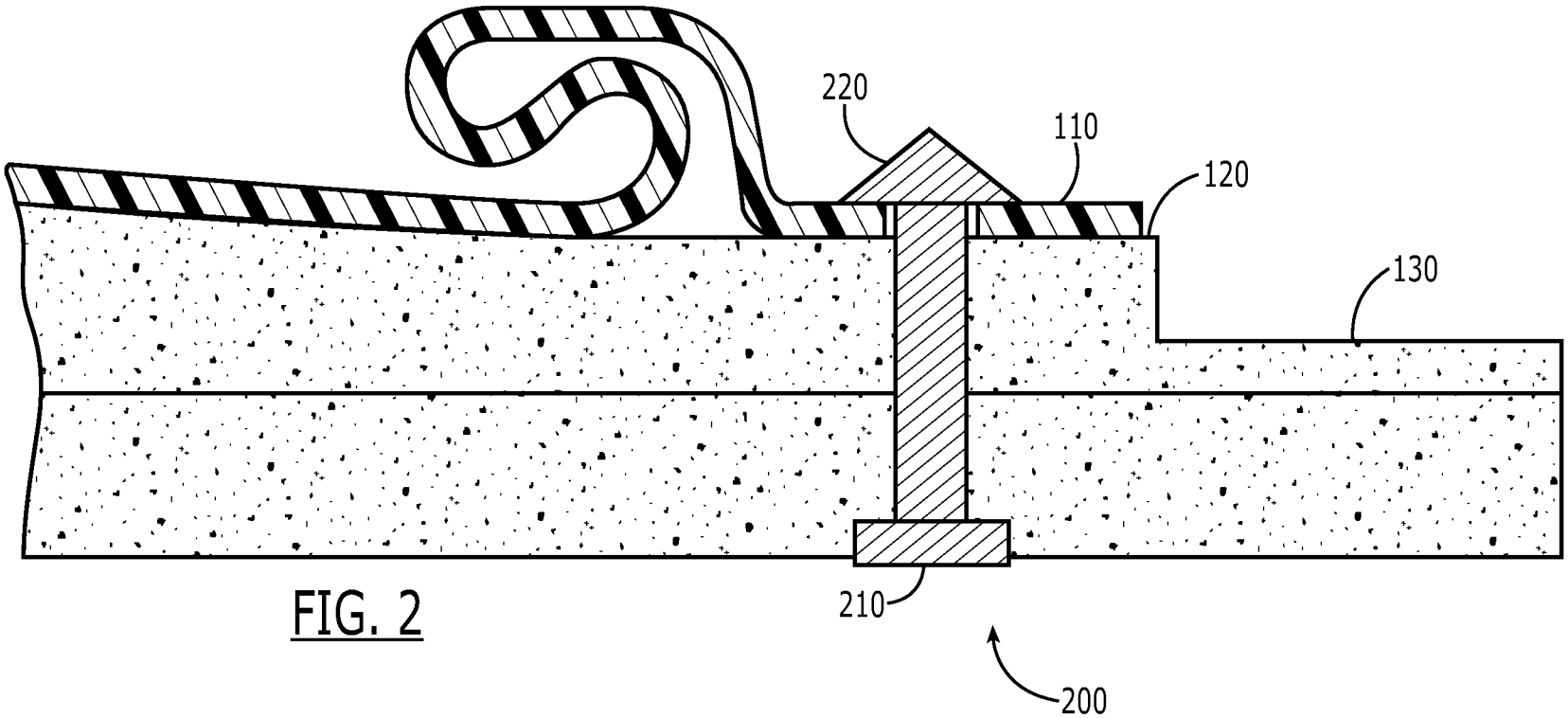
FIG. 2 shows a side view of the insulated siding of FIG. 1.

Turning now to FIG. 2, a side view of the insulated siding of FIG. 1 is shown with a non-adhesive coupling mechanism 200. In the embodiment of FIG. 2, the non-adhesive coupling mechanism 200 is a stud (shown shaded in FIG. 2) having a pointed driving end 220 and a flat head 210. Such studs are commonly known in the industry as "Christmas tree fasteners," since their profiles appear similar to the profiles of Christmas trees. The pointed driving end 220, for some embodiments, is driven through the siding from the insulation 130 side to the pane 110 side. In that regard, for such embodiments, the stud is driven in the opposite direction from a nail that will eventually be driven through the siding during installation. In other words, while a nail is driven from the panel 110 side to the insulation 130 side during installation of the siding, the stud is driven in the opposite direction to secure the panel 110 to the insulation 130. It should be appreciated that, for other embodiments, the fastener may optionally have fins that extrude from the shaft of the stud. For such embodiments, the fins assist in securing the panel 110 to the insulation 130.

For the embodiment using the stud 200, the stud 200 is aligned to one of the orifices 150 of the nailing hem 180. Thus, once aligned, the stud 200 is driven through the nailing hem 180 of the panel 110 from the insulation side. For some embodiments, the pointed driving end 220 is flanged so that, once the stud 200 is driven through the orifice 150, the force applied to the panel 110 by the flange, and the opposing force applied to the insulation 130 by the head, 210 results in a securing of the panel 110 to the insulation 130.

While the embodiment of FIG. 2 shows the flat head 210 of the stud 200 being flush with the insulation 130, it should be appreciated that the stud 200 need not be driven so far into the insulation 130, for other embodiments. In other words, unlike the embodiment shown in FIG. 2, it is also contemplated that the stud 200 can extend beyond the back surface of the insulation 130. For yet other embodiments, the stud 200 can also be driven further into the insulation 130 to form a depression at the location of the stud 200.

As shown in FIG. 2, flexible adhesive 120 can be used in conjunction with the stud 200 to secure the panel 110 to the insulation 130. Since flexible adhesives are known in the art, further discussion of flexible adhesives is omitted here.

As can be appreciated, the dimensions of the stud 200 can be altered, depending on the thickness of the insulation 130, the size of the orifice 150, and various other factors. Additionally, while a stud 200 having a head 210 and a point 220 are shown, it should be appreciated that the non-adhesive coupling mechanism can be a different type of mechanical fastener, such as, for example, a bolt, a clip, a staple, a screw, a nail, any other known mechanism, or a combination thereof. Even among these selections of fasteners, it should be appreciated that different types of bolts, clips, screws, or other variants of such fasteners can be used to non-adhesively couple the insulation 130 to the panel 110. Additionally, it should be appreciated that the fasteners can be fabricated from plastic, wood, metal, rubber, a composite material, or any combination thereof.

By using non-adhesive coupling mechanisms, such as that shown in FIG. 2, the problems concomitant to flexible adhesives can be largely avoided.

Various embodiments of the invention also include methods for fabricating the sidings shown in FIGS. 1 and 2. As such, some embodiments, among others, include the steps of providing an insulation and a panel, and non-adhesively coupling the insulation to the panel. The process of fabricating the siding of FIG. 2 can be automated by carrying the insulation 130 and the panel 110 along a conveyor, registering the location of the orifice 150, and appropriately timing the driving of the stud 200 so that it is driven through the orifice 150 of the panel.

For some embodiments, the process can be accomplished by modifying known equipment, such as, for example, the apparatus described in U.S. Pat. Nos. 6,199,740 and 6,343,730, both titled "Pneumatic Fastener Inserter and Hopper for Same," invented by Benes et al., and assigned to Waitt/Fremont Machine LLC (Fremont, Nebr.), hereinafter referred to simply as the "pneumatic gun." Since the pneumatic gun is described in great detail in the above-referenced patents, and is generally known to those of skill in the art, only relevant modifications to the pneumatic gun are described in detail below. U.S. Pat. Nos. 6,199,740 and 6,343,730 are incorporated herein by reference, as if set forth in their entireties.

Figure 3A:
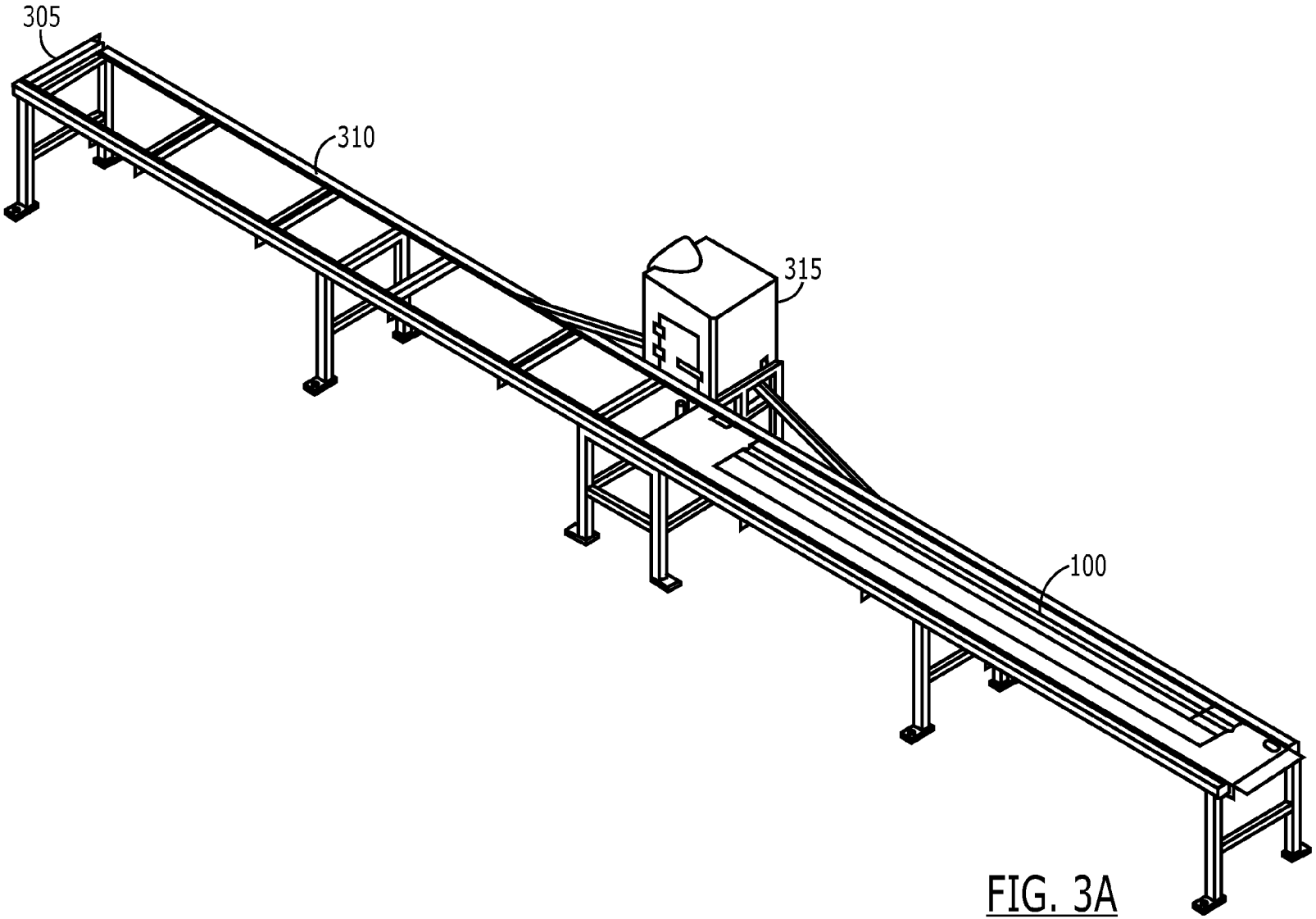
FIGS. 3A through 3D show an apparatus configured to mechanically fasten an insulation to a panel.
Figure 3B:
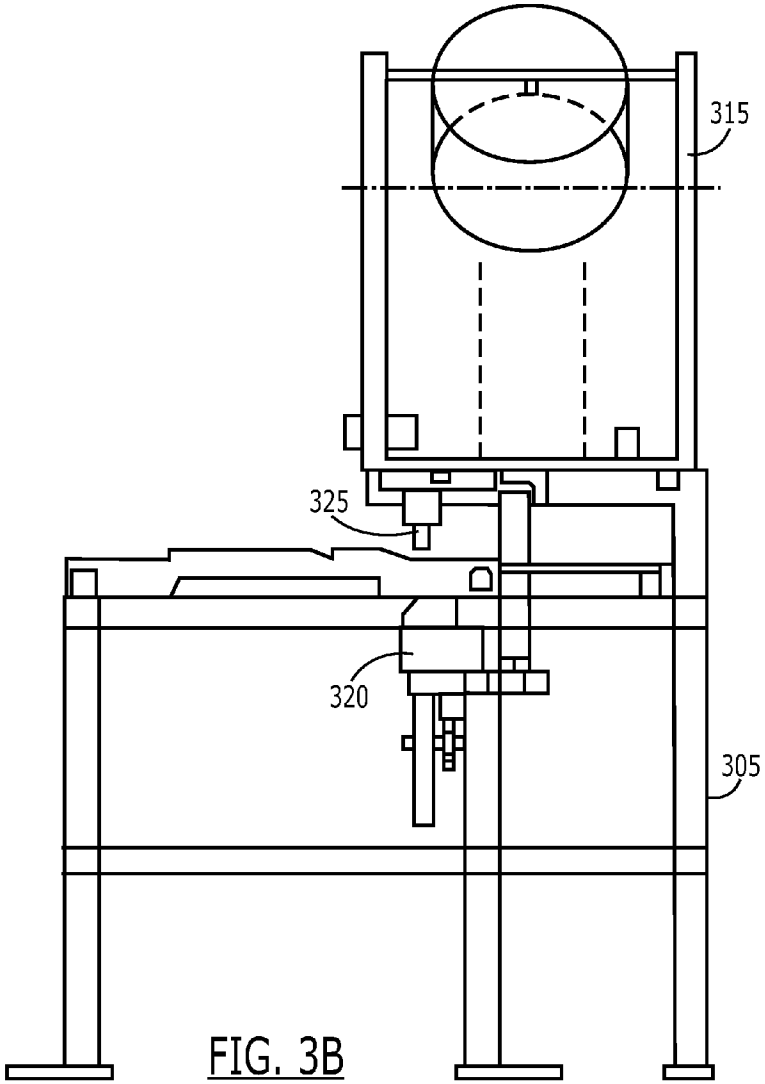
Figure 3C:
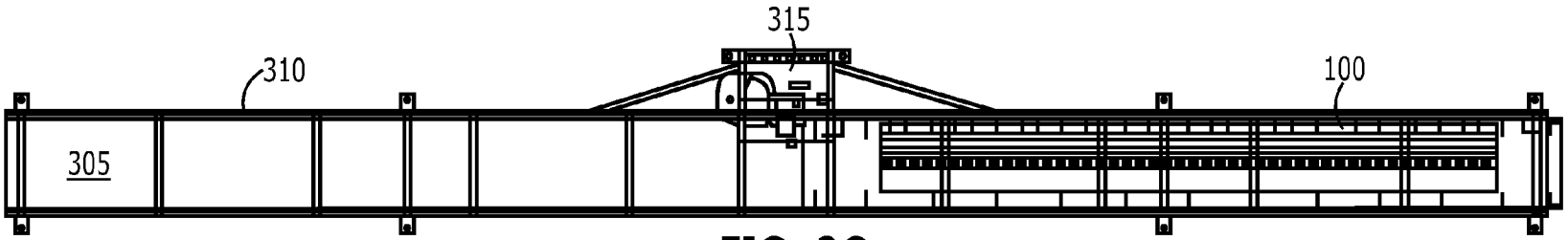
Figure 3D:
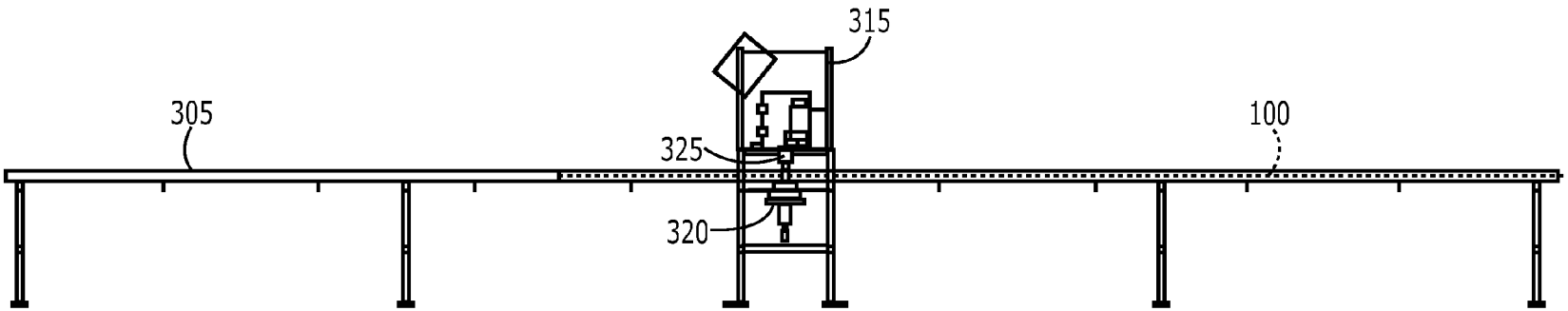

FIGS. 3A through 3D show an apparatus configured to mechanically fasten an insulation to a panel. Specifically, FIG. 3A shows a perspective view of a modified pneumatic gun 315; FIG. 3B shows a side view of the apparatus of FIG. 3A; FIG. 3C shows a top view of the apparatus of FIG. 3A; and FIG. 3D shows a front view of the apparatus of FIG. 3A.

The apparatus of FIGS. 3A through 3D show a modified pneumatic gun 315 that is configured to insert fasteners into foam-insulated vinyl siding 100. However, it should be appreciated that such an apparatus can be readily modified to accommodate other types of insulation or reinforcement and other types of panels.

As shown in FIGS. 3A through 3D, for some embodiments, the pneumatic gun 315 can be modified so that it is coupled to a conveyor 305 that advances the siding 100. In one embodiment, among others, the conveyor 305 moves the siding 100 past the pneumatic gun 315, so that the pneumatic gun 305 can fire fasteners into the siding 100, preferably, through the nailing hem of the siding.

The conveyor 305 includes a guide rail 310. Preferably, the siding 100 travels along the guide rail 310, so that the siding 100 will be aligned to a fixed position along the length of the conveyor 305. The guide rail 310 thereby aligns the siding 100 to the pneumatic gun 315 so that the position of the nailing hem is at a fixed distance from the pneumatic gun 315. In other words, the guide rail 310 assists in positioning the pneumatic gun 315 such that the fastener will be driven through substantially the center of any given nailing hem.

To insert the fastener into the siding 100, for some embodiments, the head 320 of the pneumatic gun 315 is mounted below the conveyor 305, as shown in FIGS. 3B and 3D, at a fixed offset from the guide rail 310. Preferably, the fixed offset is equal to the distance of the nailing hem from the edge of the siding 100. In other words, the head 320 of the pneumatic gun 315 is mounted so that the fastener will be driven through the nailing hem as the siding 100 travels along the guide rail 310 of the conveyor 305.

For those embodiments in which the head 320 of the pneumatic gun 315 is located below the conveyor 305, a bracket 325 is situated above the conveyor 305. The bracket 325 applies a counterforce to the siding 100. In that regard, as the fastener is driven from the insulation-side, through the insulation, and subsequently through the nailing hem of the panel, the bracket 325 applies a stabilizing force to the panel-side, thereby substantially preventing the siding 100 from becoming misaligned from the guide rail 310. In other words, as the fastener applies a force to the insulation-side during insertion, the bracket 325 applies a substantially equal force to the panel-side. These two countervailing forces maintain a substantial equilibrium to keep the siding 100 from being jolted off of the conveyor 305.

In order to completely automate the process, sensors (not shown) can be mounted on the conveyor 305 for some embodiments. For those embodiments, the sensors can detect the location of the nailing hem as the siding 100 travels along the conveyor 305. The speed of the conveyor 305 can be adjusted accordingly so that the fastener can be driven through approximately the center of the nailing hem.

For some embodiments, multiple pneumatic guns can be mounted onto a single conveyor unit, thereby permitting multiple substantially-concurrent insertions of fasteners. For yet other embodiments, the head of the pneumatic gun can be mounted onto servo mechanisms, thereby permitting lateral and transverse movements of the head. This permits fine or coarse adjustments of the location of the fastener with reference to the siding.

It should be appreciated that the entire process may be computerized so as to minimize human interaction. In that regard, the speed of the conveyor, the location of the pneumatic gun, the size of the fasteners, the relative force of the pneumatic gun, and a host of other variables can be adjusted to optimize the process by which the fasteners are driven into the siding. Since such optimization parameters are readily ascertainable with minimal experimentation, such optimizations are not discussed herein.

Also, while a particular embodiment using the pneumatic gun is described above, it should be appreciated that comparable processes can be developed for other fastening mechanisms. Since the application to other fasteners is relatively straight-forward, discussion of such processes is omitted here.

Various embodiments of the invention also include methods for installing the sidings shown in FIGS. 1 and 2. As such, some embodiments, among others, include the steps of obtaining a siding in which a panel and an insulation are secured to each other by a non-adhesive coupling, positioning the siding at a given location on a wall, and securing the siding to the wall. Typically, the siding can be secured to the wall by driving a nail through one or more orifices in the nailing hem.

It should be appreciated that the structure, on which the siding is mounted, can be a residential building (e.g., house, apartment, condominium, etc.) or a commercial building (e.g., warehouse, garage, etc.). In fact, the sidings can be mounted onto any building structure that is commonly known in the art.

Although exemplary embodiments have been shown and described, it will be clear to those of ordinary skill in the art that a number of changes, modifications, or alterations to the disclosure as described may be made. For example, while various mechanical fasteners are recited for the non-adhesive coupling, it should be appreciated that other mechanical fasteners can be used to secure the panel to the insulation. Similarly, while vinyl siding is shown to clearly illustrate various embodiments of the invention, it should be appreciated that the panel need not be fabricated from vinyl, but may be fabricated from other known materials, such as metals, plastics, composites, etc., which can be used in the industry for siding. Additionally, while foam insulation is disclosed for some embodiments, it should be appreciated that other embodiments can include other insulating or non-insulating material. All such changes, modifications, and alterations should therefore be seen as within the scope of the disclosure.

The invention claimed is:

1. An insulated vinyl siding, comprising:

a. a foam insulation having a first coefficient of thermal expansion, a planar backside and a contour;

b. a vinyl panel having a second coefficient of thermal expansion, where the first coefficient of thermal expansion is not equal to the second coefficient of thermal expansion;

c. a fastener that couples the foam insulation and the vinyl panel together while still permitting independent movement between substantially all of the foam insulation and substantially all of the vinyl panel when temperature changes cause differential changes in the foam insulation and the vinyl panel; and, d. wherein the fastener has a driving point end that is driven through the planer backside of the foam insulation, the nailing hem of the vinyl panel, and is proximate to the nailing hem; and a flat head end that is proximate to the planar backside of the foam insulation.

2. The insulated vinyl siding of claim 1 further comprising: The vinyl panel has a nailing hem and a contour corresponding substantially to the contour of the foam insulation, wherein the fastener has been driven from the planar back side of the foam insulation, through the foam insulation and through the nailing hem of the vinyl panel such that independent movement between the foam insulation and the vinyl panel is still permitted.

3. The insulated vinyl siding of claim 1 wherein a flexible adhesive is used to attach the vinyl panel and the foam insulation together.

4. The insulated vinyl siding of claim 1 further comprising:

A termite treatment in the foam insulation.

5. The insulated vinyl siding of claim 1 further comprising:

A flame-retardant material in the foam insulation.

6. A vinyl siding comprising:

A foam insulation having a first coefficient of thermal expansion, a planer back side and an opposing contour side;

a vinyl panel having a second coefficient of thermal expansion, where the first coefficient of thermal expansion is not equal to the second coefficient of thermal expansion, and a contour corresponding substantially to the contour of the foam insulation and a nailing hem; and a fastener having a first end with a driving point, a second end with a flat head and a shaft connecting the first end with the second end, the first end is proximate the nailing hem of the vinyl panel and the second end is proximate the planar backside of the foam insulation, wherein substantially all of the foam insulation and the vinyl panel may move independently of each other when the foam insulation and the vinyl panel undergo different rates of thermal expansion and contraction.

7. The insulated vinyl siding of claim 6 further comprising a flexible adhesive is used to attached the vinyl panel and the foam insulation together while still permitting the foam insulation and the vinyl panel to move independently of each other when the foam insulation and the vinyl panel undergo different rates of thermal expansion and contraction.

8. The insulated vinyl siding of claim 6 further comprising:

A termite treatment in the foam insulation.

9. The insulated vinyl siding of claim 6 further comprising:

A flame-retardant material in the foam insulation.

10. A siding comprising:

a fastener;

an insulation with a first coefficient of thermal expansion, a planer back and a contour; and a panel with a second coefficient of thermal expansion, where the first and second coefficient of thermal expansion are not equal, and a contour that substantially matches the contour of the insulation, where the fastener permits independent movement of substantially all of the insulation and the panel, wherein the fastener has a driving point end that is driven through the planar back of the foam insulation, the nailing hem of the vinyl panel, and is proximate to the nailing hem; and a flat head end that is proximate to the planar back of the foam insulation.

11. A siding according to claim 10 wherein the panel has a nailing hem wherein the fastener has been driven from the planer back side of the insulation through the foam insulation and through the nailing hem of the panel such that independent movement between the foam insulation and the vinyl panel is permitted.

12. A siding according to claim 10 wherein the panel has a nailing hem wherein the fastener has been driven through the nailing hem of the panel and through the insulation such that independent movement between the foam insulation and the vinyl panel is permitted.

13. The siding of claim 10 wherein a flexible adhesive is used to attach the vinyl panel and the foam insulation together.

14. The insulated vinyl siding of claim 10 further comprising:

A termite treatment in the insulation.

15. The insulated vinyl siding of claim 10 further comprising:

A flame-retardant material in the insulation.

16. A method for installing sidings, the method comprising the steps of:

obtaining a siding having a panel with a first coefficient of thermal expansion and an insulation with a second coefficient of thermal expansion, where the first coefficient of thermal expansion is not equal to the second coefficient of thermal expansion, the panel being secured to the insulation by a coupling that permits substantially all of the panel to move independently of the insulation, wherein the coupling has a driving point end that is driven through the backside of the panel and is proximate to the nailing hem; and a flat head end that is proximate to the panel backside, positioning the siding on the exterior of a building structure for installation; and securing the siding to a structure.

* * * * *